US008716637B2

(12) United States Patent
Ripley et al.

(10) Patent No.: US 8,716,637 B2
(45) Date of Patent: May 6, 2014

(54) FLUIDIZED BED HEAT TREATING SYSTEM

(75) Inventors: Edward B. Ripley, Knoxville, TN (US); Glenn L. Pfennigwerth, Knoxville, TN (US)

(73) Assignee: Babcock & Wilcox Technical Services Y-12, LLC, Oak Ridge, TN (US)

( * ) Notice: Subject to any disclaimer, the term of this patent is extended or adjusted under 35 U.S.C. 154(b) by 1222 days.

(21) Appl. No.: 12/486,823

(22) Filed: Jun. 18, 2009

(65) Prior Publication Data

US 2010/0320197 A1 Dec. 23, 2010

(51) Int. Cl.
*H05B 6/64* (2006.01)
*F27B 15/00* (2006.01)

(52) U.S. Cl.
USPC ..... 219/679; 219/759; 219/762; 432/58; 432/197

(58) Field of Classification Search
USPC ..... 219/679, 690, 756, 759, 730, 762, 775; 432/9, 200, 58, 197, 199; 122/4 D; 148/209, 281
See application file for complete search history.

(56) References Cited

U.S. PATENT DOCUMENTS

| | | | | |
|---|---|---|---|---|
| 3,053,704 | A * | 9/1962 | Munday | 148/710 |
| 3,921,590 | A * | 11/1975 | Mitchell et al. | 122/4 D |
| 4,310,747 | A * | 1/1982 | Rice et al. | 392/466 |
| 5,316,594 | A * | 5/1994 | Kemp | 148/281 |
| 5,387,780 | A * | 2/1995 | Riley | 219/688 |
| 5,808,282 | A * | 9/1998 | Apte et al. | 219/679 |
| 7,161,126 | B2 | 1/2007 | Ripley | |
| 7,358,469 | B2 | 4/2008 | Ripley | |
| 2002/0009383 | A1 * | 1/2002 | Kawaura et al. | 420/418 |
| 2005/0263219 | A1 | 12/2005 | Hoeschele et al. | |
| 2007/0266825 | A1 | 11/2007 | Ripley et al. | |
| 2008/0023109 | A1 | 1/2008 | Taguchi et al. | |

FOREIGN PATENT DOCUMENTS

| | | | |
|---|---|---|---|
| JP | 2003062452 | A | 3/2003 |
| JP | 2004014631 | A | 1/2004 |
| JP | 2005235464 | A | 9/2005 |

* cited by examiner

*Primary Examiner* — Henry Yuen
*Assistant Examiner* — Hung D Nguyen
(74) *Attorney, Agent, or Firm* — Michael J. Renner, Esq.; Luedeka Neely Group, P.C.

(57) ABSTRACT

Systems for heat treating materials are presented. The systems typically involve a fluidized bed that contains granulated heat treating material. In some embodiments a fluid, such as an inert gas, is flowed through the granulated heat treating medium, which homogenizes the temperature of the heat treating medium. In some embodiments the fluid may be heated in a heating vessel and flowed into the process chamber where the fluid is then flowed through the granulated heat treating medium. In some embodiments the heat treating material may be liquid or granulated heat treating material and the heat treating material may be circulated through a heating vessel into a process chamber where the heat treating material contacts the material to be heat treated. Microwave energy may be used to provide the source of heat for heat treating systems.

11 Claims, 4 Drawing Sheets

FLUIDIZED BED HEAT TREATING SYSTEM

GOVERNMENT RIGHTS

The U.S. Government has rights to this invention pursuant to contract number DE-AC05-00OR22800 between the U.S. Department of Energy and Babcock & Wilcox Technical Services Y-12, LLC.

FIELD

This disclosure relates to the field of heat treatment of materials. More particularly, this disclosure relates to heat treatment of materials using fluidized bed systems.

BACKGROUND

Heat treating systems for materials typically involve energy-intensive processes. In addition to high energy consumption during a heat treatment operation, considerable energy is typically wasted either while maintaining a heat treatment system in operational standby mode (e.g., while awaiting the arrival of parts to be heat treated), or while heating a heat treatment system to take it from a shut-down mode to an operational mode. In addition, many heat treatment systems utilize heat treating media that require a long time to heat to operational temperature. What are needed therefore are improved systems for heat treating that are more energy efficient and that may be started up more rapidly.

SUMMARY

The present disclosure provides a system for heat treating material. A typical embodiment includes a process vessel having a wall enclosing a process chamber for containing microwave energy. A perforated separator is generally provided in the process chamber and granulated heat treating material is disposed in the process chamber in contact with the material to be heat treated. In this embodiment the granulated heat treating material comprises microwave susceptor granulated material. There is a fluid injection system for flowing a fluid into the process chamber and through the perforated separator and through the granulated heat treating material. Generally an exhaust port is for ejecting the fluid from the process chamber after the fluid has flowed through the granulated heat treating material. This embodiment also employs a microwave guide extending substantially through the entire wall of the process vessel. The microwave guide directs microwave energy into the process chamber where the microwave energy couples with at least a portion of the microwave susceptor granulated heat treating material.

In a further embodiment of a system for heat treating material there is a heating chamber. A heat transfer material is disposed in the heating chamber. A heat source is provided for heating the heat transfer material. There is a process chamber and granulated heat treating material is disposed in the process chamber in contact with the material to be heat treated. In this embodiment a fluid circulation system conveys a fluid from the heating chamber to the process chamber and back to the heating chamber, such that the fluid absorbs heat from the heat transfer material and transfers at least a portion of the heat to the granulated heat treating material.

Further embodiments provide a system for heat treating material that includes a heating chamber with a first portion of a heat treating material disposed in the heating chamber. Also provided is a process chamber with a second portion of the heat treating material disposed in the process chamber in contact with the material to be heat treated. There is a heat source for heating the first portion of the heat treating material. Also provided is a heat treating material circulation system for conveying at least a portion of the first portion of heat treating material from the heating chamber into the process chamber and for conveying at least a portion of the second portion of the heat treating material from the process chamber into the heating chamber to form a circulating heat treating material. The circulating heat treating material contacts the material to be heat treated.

BRIEF DESCRIPTION OF THE DRAWINGS

Various advantages are apparent by reference to the detailed description in conjunction with the figures, wherein elements are not to scale so as to more clearly show the details, wherein like reference numbers indicate like elements throughout the several views, and wherein.

DETAILED DESCRIPTION

In the following detailed description of the preferred embodiments, reference is made to the accompanying drawings, which form a part hereof, and within which are shown by way of illustration the practice of specific embodiments of heat treatment systems. It is to be understood that other embodiments may be utilized, and that structural changes may be made and processes may vary in other embodiments.

Figure 1:
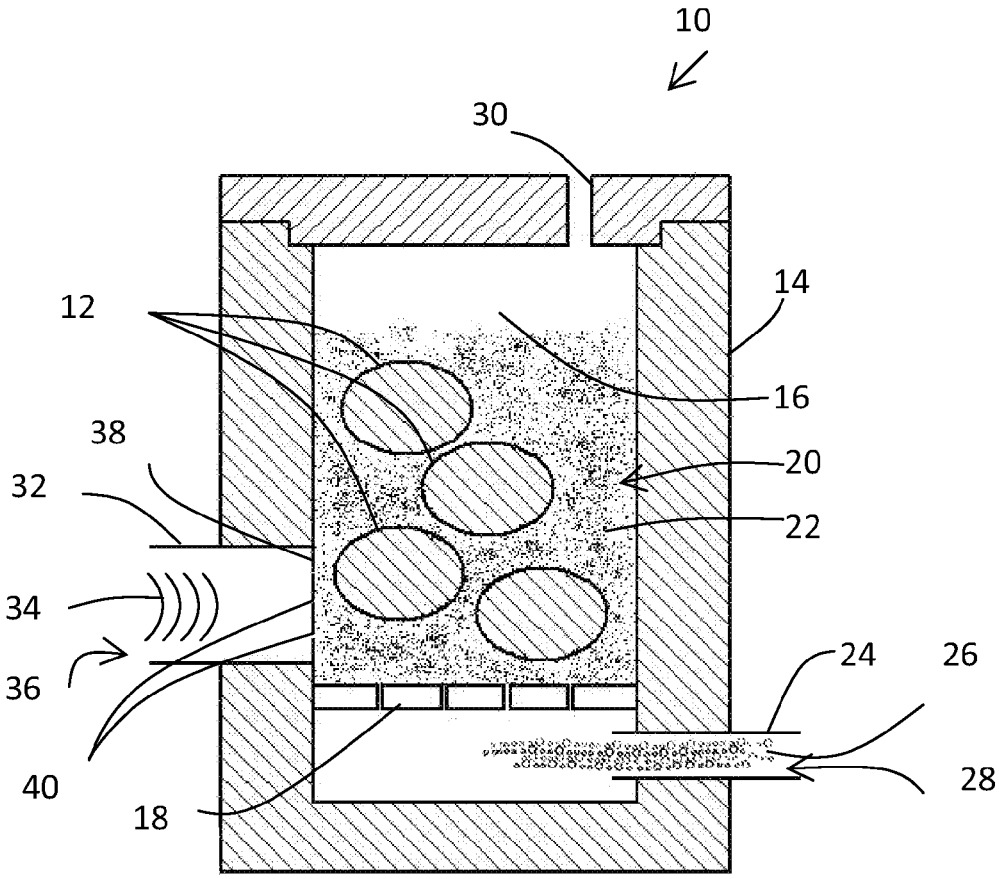
FIGS. 1, 2, 3, and 4 are somewhat schematic cross sectional elevation views of four heat treatment systems.

One embodiment of a heat treatment system 10 is illustrated in FIG. 1. The heat treatment system 10 is configured to heat treat various pieces of material 12. The heat treatment system 10 includes a process vessel 14 that has a process chamber 16 that is configured to contain microwave energy. There is a perforated separator 18 in the process vessel 14, and the process chamber 16 is configured with granulated heat treating material 20 that contacts the material 12 to be heat treated. In the embodiment of FIG. 1, the granulated heat treating material 20 includes microwave susceptor granulated material 22, such as granular silicon carbide.

There is a fluid injection system 24 that flows a fluid 26 into a chamber 28 and from there into the process chamber 16. The fluid 26 is usually a gas and is typically an inert gas such as argon or nitrogen, but in some embodiments the fluid 26 may be a liquid. A combination of the size of the perforations in the perforated separator 18 and the pressure of the fluid in the chamber 28 may be used to prevent the granulated heat treating material 20 from flowing through the perforated separator 18 into the chamber 28. The fluid 26 flows from the chamber 28 through the perforated separator 18 and into the granulated heat treating material 20. There is an exhaust port 32 where the fluid 26 exits the process chamber 16 after percolating through the granulated heat treating material 20. In most embodiments the fluid 26 that exits the process chamber 16 through the exhaust port 32 is recycled through the fluid injection system 24 back into the process chamber 16.

Continuing with FIG. 1, there is a microwave waveguide 34 that is configured to direct microwave energy 36 into the process chamber 16 through a third opening 38. The waveguide 34 passes substantially all the way through the wall 40 of the process vessel. The microwave energy 36 couples with and heats the microwave susceptor granulated material 22. In some embodiments the granulated heat treating material 20 includes microwave transparent granulated material, such as aluminum oxide. Such material is typically less dense than the microwave susceptor granulated material 22 and the microwave transparent granulated material facilitates mixing and percolation of the fluid 26 through the granulated heat treating material 20. The heated microwave susceptor granulated material 22 heats other non-suscepting components (if any) of the granulated heat treating material 20 by means of heat conduction, convection, and radiation effects. The heated granulated heat treating material 20 contacts and heat treats the material 12 to be heat treated.

A baffle 42 is designed with openings 44 that permit the microwave energy 36 to pass through openings 44 into the process chamber 16. The baffle 42 is configured to prevent the granulated heat treating material 20 from flowing into the microwave waveguide 34. The flow of the fluid 26 tends to homogenize the temperature of the granulated heat treating material 20 in the process chamber 16. Typically the microwave waveguide 34 is sealed off from atmosphere so that the fluid 26 does not continuously leak out of the process chamber 16 through the baffle 42.

The fluid injection system 24 and the exhaust port 32 are designed with waveguide-beyond-cutoff dimensions so that the microwave energy 36 does not leak from the process chamber 16 through the fluid injection system 24 or the exit port 32.

In the embodiment of FIG. 1 the microwave energy 36 directly couples with at least a portion of the microwave susceptor granulated heat treating material 22 without passing through any unavoidable intermediary material, even material that may be substantially microwave transmissive. That is, the microwave energy 36 encounters only air (which is typically present in the microwave guide 34) and the baffle 42 before entering the process chamber 16. This configuration may improve the efficiency of the heat treating system 10 because any extraneous material, even material that is substantially microwave transparent, may absorb or reflect some of the microwave energy 36 before it reaches the microwave susceptor granulated heat treating material 22.

Figure 2:
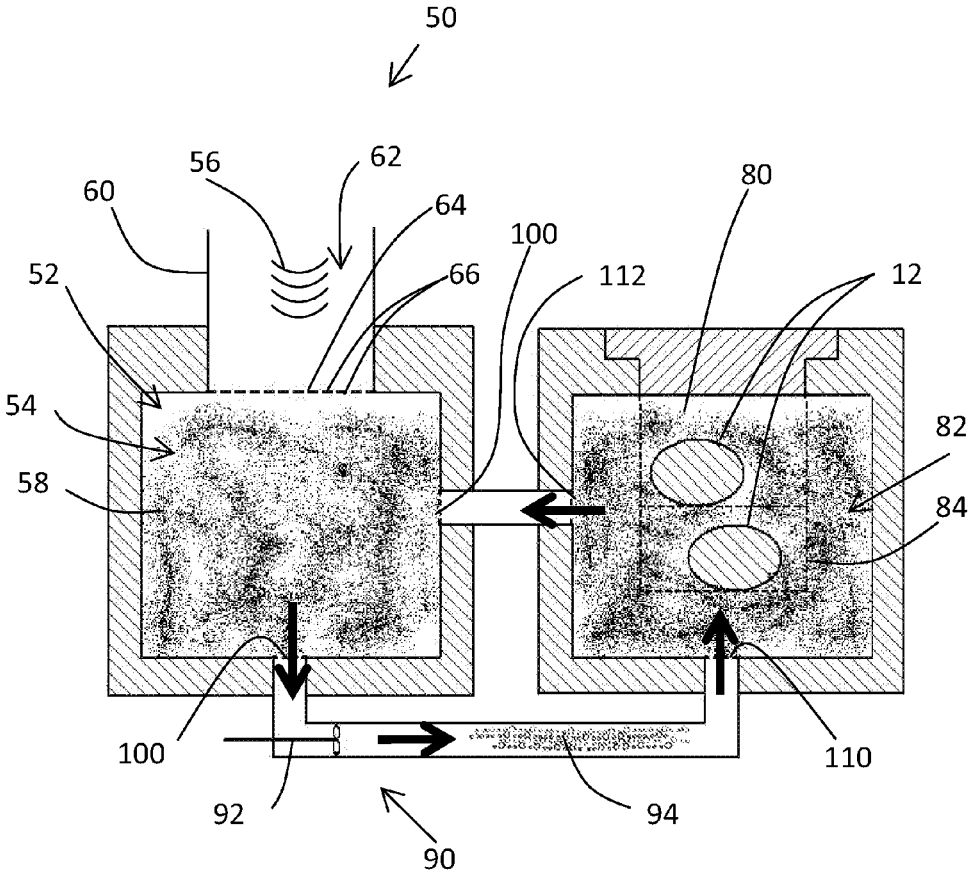
Figure 4:
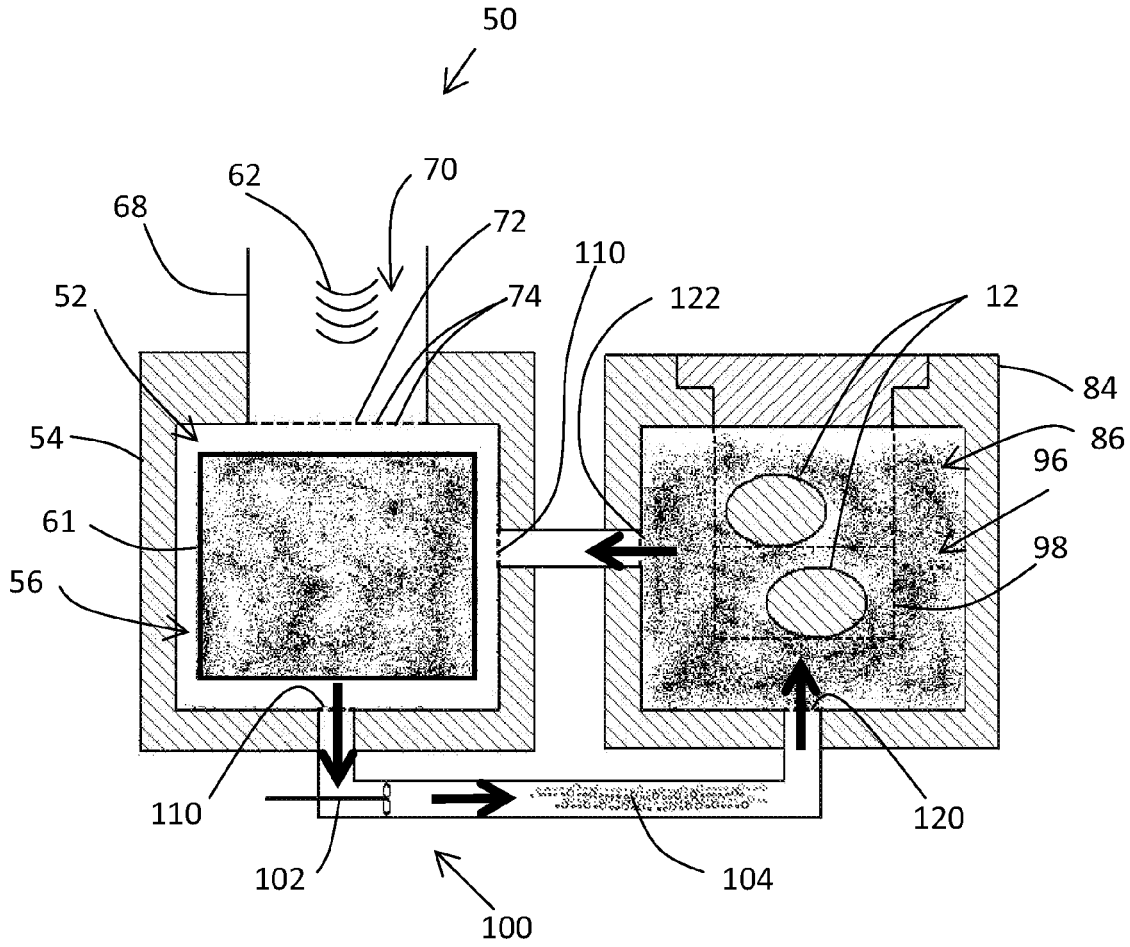

FIG. 2 depicts an embodiment of a heat treating system 50 that is configured for heat treating various pieces of material 12. There is a heating vessel 54 that includes a heating chamber 56 that is configured to heat granulated heat transfer material 60. Referring to FIG. 4, which depicts an embodiment similar to the embodiment of FIG. 2, in some embodiments a porous block of heat transfer material 61 may be used instead of the granulated heat transfer material 60. In the embodiment of FIG. 2 the heating is accomplished by microwave energy 62 but in other embodiments the granulated heat transfer material 60 may be heated by thermal combustion, electrical resistance, induction, or other heating methods. In the embodiment of FIG. 2 the granulated heat transfer material 60 includes microwave susceptor granulated material 64, such as granular silicon carbide. It is understood herein that references to microwave susceptor material includes material that is only partially suscepting (and therefore partially transparent and/or partially reflective) of microwave energy. In embodiments that employ a porous block of heat transfer material (and that use microwave energy to heat the heat transfer material), the porous block includes microwave susceptor material.

In the embodiment of FIG. 2 a microwave waveguide 68 is configured to direct the microwave energy 62 into the heating chamber 56 through a first heating chamber opening 70. A waveguide baffle 72 is provided and in this embodiment the waveguide baffle is configured with openings 74 that permit the microwave energy 62 to pass through the openings 74 into the heating chamber 56 while preventing the granulated heat transfer material 60 from flowing into the microwave waveguide 68. In other embodiments the waveguide baffle 72 may be fabricated from a solid substantially microwave transparent material such as aluminum oxide. The microwave energy 62 couples with and heats the microwave susceptor granulated material 64. In the embodiment of FIG. 2 the waveguide 68 passes through a wall 78 of the heating vessel 54, but in other embodiments the wall 78 of the heating vessel 54 may be substantially transparent to microwave energy and in such configurations the waveguide 68 may not extend into the wall 78, and instead the waveguide 68 may direct the microwave energy 62 through the microwave-transparent wall 78 of the heating vessel 54.

The granulated heat transfer material 60 may include microwave transparent heat transfer granulated material. The heated microwave susceptor granulated material 64 may heat other non-suscepting components (if any) of the granulated heat transfer material 60 by means of heat conduction, convection, and/or radiation effects.

The heat treating system 50 also includes a process vessel 84 having a process chamber 86 that is spaced apart from the heating chamber 56 and configured with granulated heat treating material 96 that contacts the material 12 that is to be heat treated. The material 12 that is to be heat treated is typically supported by a porous basket 98. The granulated heat treating material 96 may comprise one or more ceramic materials, salts, metals, or other heat treating media. There is a fluid circulation system 100 that employs a fan 102 (or a pump in the cases where a liquid fluid is used) to circulate a fluid 104 from the heating chamber 56 to the process chamber 86 and back to the heating chamber 56. The fluid 104 is usually a gas and is typically an inert gas such as argon or nitrogen. In embodiments that include microwave transparent heat transfer granulated material, such material is typically less dense than the microwave susceptor granulated material 64, and the microwave transparent heat transfer granulated material facilitates the flow of the fluid 104 through the granulated heat transfer material 60. In embodiments that utilize a porous block of heat transfer material, the porous block of heat transfer material may include material that is substantially microwave transparent, such as aluminum oxide, which may improve the porosity of the block of heat transfer material. In the embodiment of FIG. 2, the fluid 104 absorbs heat from the granulated heat transfer material 60 and conveys heat to the granulated heat treatment material 96. The granulated heat treating material 96 contacts and heat treats the material 12 to be heat treated.

Typically the waveguide 68 is sealed off from atmosphere so that the fluid 104 does not continuously leak out of the heating chamber 56 through the waveguide baffle 72. Heating chamber baffles 110 prevent the granulated heat transfer material 60 from flowing out of the heating chamber 56. The heating chamber baffles 110 are also configured with waveguide-beyond-cutoff dimensions to prevent the microwave energy 62 from leaking out of the heating chamber 56 into the fluid circulation system 100. A first process chamber baffle 120 and a second process chamber baffle 122 are provided to prevent the granulated heat treatment material 96 from flowing out of the process chamber 86. The first process chamber baffle 120 may also be configured as a diffuser to help distribute the flow of the fluid 104 throughout the granulated heat treatment material 96.

Figure 3:
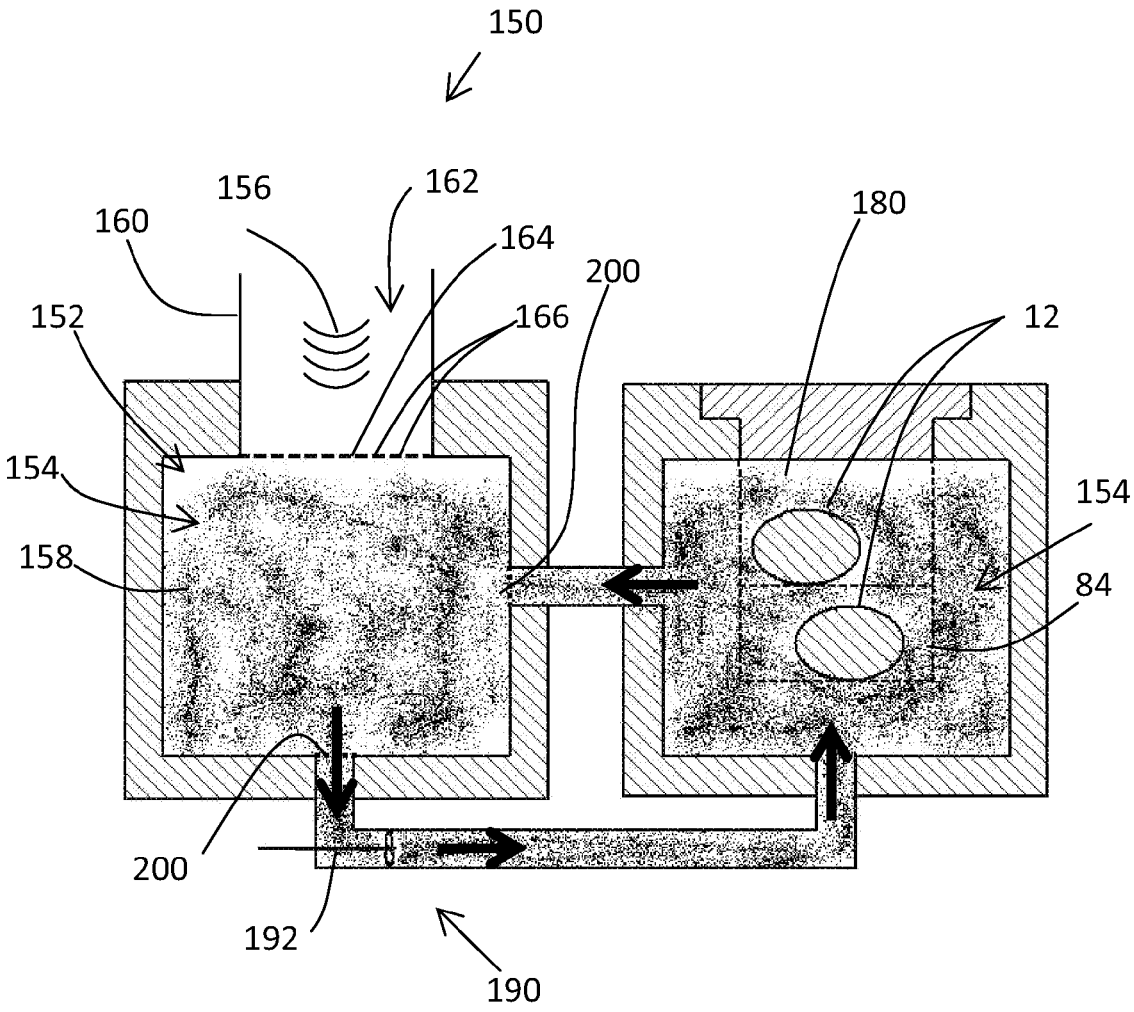

FIG. 3 depicts an embodiment of a heat treating system 150 that is configured for heat treating various pieces of material 12. There is a heating vessel 154 that includes a heating chamber 156 that is configured to heat a first portion of a heat treating material 160. In the embodiment of FIG. 3 the heat treating material is a granulated material, but in other embodiments the heat treating material 160 may be a liquid heat treating material, such as a molten salt or a slurry such as a liquid/powder mixture. In the embodiment of FIG. 3 the heating is accomplished by microwave energy 162 delivered into the heating chamber 156. In other embodiments the first portion of heat treating material 160 may be heated by thermal combustion, electrical resistance, induction, or other heating methods.

In the embodiment of FIG. 3 the first portion of heat treating material 160 includes microwave susceptor material 164, such as granular silicon carbide. A waveguide baffle 172 is provided and in this embodiment the waveguide baffle 172 has openings 174 that permit the microwave energy 162 to pass through openings 174 into the heating chamber 156 while preventing the first portion of the heat treating material 160 from flowing into the microwave waveguide 168. In other embodiments the waveguide baffle 172 may be fabricated from a solid substantially microwave transparent material such as aluminum oxide. The microwave energy 162 couples with and heats the microwave susceptor material 164. The heated microwave susceptor material 164 heats other non-suscepting components (if any) of the first portion of heat treating material 160 by means of heat conduction, convection, and/or radiation effects.

In the embodiment of FIG. 3 the waveguide 168 passes through a first heating chamber opening 170 through a wall 178 of the heating vessel 54, but in other embodiments the wall 178 of the heating vessel 54 may be substantially transparent to microwave energy and in such configurations the waveguide 168 may not extend into the wall 178, and instead the waveguide 168 may direct the microwave energy 162 through the microwave-transparent wall 178 of the heating vessel 154.

Typically the microwave waveguide 168 is sealed off from atmosphere so that there is no significant loss of pressure through the waveguide baffle 172. Heating chamber baffles 210 are provided and configured with waveguide-beyond-cutoff dimensions to prevent the microwave energy 162 from leaking out of the heating chamber 156 into the circulation system 200.

The heat treating system 150 also includes a process vessel 184 having a process chamber 186 that is spaced apart from the heating chamber 156 and is configured with a second portion of the heat treating material 196 that contacts the material 12 that is to be heat treated. The material 12 that is to be heat treated is typically supported by a porous basket 98. There is a heat treating material circulation system 200 that employs a fan 202 (or a pump in a liquid heat treating material system) to circulate at least a portion of the first portion of the heat treating material 160 from the heating chamber 156 to the process chamber 186 where it mixes with the second portion of the heat treating material 196. The heat treating material circulation system 200 also circulates at least a portion of the second portion of the heat treating material 196 from the process chamber 186 into the heating chamber 156, along with at least a portion of the portion of the first portion of the heat treating material that was conveyed by the heat treating material circulation system 200 from the heating chamber 156 to the process chamber 186. As the heat treating material circulation system 200 operates at least a portion of the original first portion of the heat treating material 160 is transported into the process chamber 186 and mixes with the original second portion of the heat treating material 196, and at least a portion of the original second portion of the heat treating material 196 is transported into the heating chamber 156 and mixes with the original first portion of the heat treating material 156, such that the first portion of the heat treating material 160 and the second portion of the heat treating material become a circulating heat treating material 220. The circulating heat treating material 220 contacts and heat treats the material 12 to be heat treated.

In summary, embodiments disclosed herein provide various systems for heat treating material. The foregoing descriptions of embodiments have been presented for purposes of illustration and exposition. They are not intended to be exhaustive or to limit the embodiments to the precise forms disclosed. Obvious modifications or variations are possible in light of the above teachings. The embodiments are chosen and described in an effort to provide the best illustrations of principles and practical applications, and to thereby enable one of ordinary skill in the art to utilize the various embodiments as described and with various modifications as are suited to the particular use contemplated. All such modifications and variations are within the scope of the appended claims when interpreted in accordance with the breadth to which they are fairly, legally, and equitably entitled.

What is claimed is:

1. A system for heat treating material comprising
a heating chamber;
a heat transfer material disposed in the heating chamber;
a heat source for heating the heat transfer material;
a process chamber spaced-apart from the heating chamber;
granulated heat treating material disposed in the process chamber in contact with the material to be heat treated; and
a fluid circulation system for conveying a fluid from the heating chamber to the process chamber and back to the heating chamber, wherein the fluid absorbs heat from the heat transfer material and transfers at least a portion of the heat to the granulated heat treating material without transferring the heat transfer material from the heating chamber to the process chamber,
the heating chamber including a plurality of baffles dimensioned and configured for preventing the heat transfer material from exiting the heating chamber.

2. The system of claim 1 wherein the fluid consists of a gas.

3. The system of claim 2 wherein the gas consists of an inert gas.

4. The system of claim 1 wherein the heat transfer material comprises a porous block of heat transfer material.

5. The system of claim 1 wherein the heat transfer material comprises granulated heat transfer material.

6. The system of claim 1 wherein:
the heat source comprises a microwave generator for generating microwave energy;
the heating chamber comprises a microwave chamber;
the heat transfer material comprises microwave susceptor material; and
the system further comprises a microwave guide configured for directing the microwave energy into the heating chamber wherein the microwave energy couples with at least a portion of the microwave susceptor material.

7. The system of claim 1 wherein:
the heat source comprises a microwave generator for generating microwave energy;
the heating chamber comprises a microwave chamber;
the heat transfer material comprises microwave susceptor material and microwave transparent material; and
the system further comprises a microwave guide for directing the microwave energy into the heating chamber wherein the microwave energy couples with at least a portion of the microwave susceptor material.

8. A system for heat treating material comprising
a heating chamber;

a heat transfer material disposed in the heating chamber, the heat transfer material comprising of a porous block of microwave susceptor material;

a microwave heat source for generating microwave energy for heating the heat transfer material;

a process chamber spaced-apart from the heating chamber;

granulated heat treating material disposed in the process chamber in contact with the material to be heat treated; and a fluid circulation system for conveying a fluid from the heating chamber to the process chamber and back to the heating chamber, wherein the fluid absorbs heat from the heat transfer material and transfers at least a portion of the heat to the granulated heat treating material without transferring the porous block of heat transfer material from the heating chamber to the process chamber.

9. The system of claim 8 wherein:

the heating chamber comprises a microwave chamber; and the system further comprises a microwave guide configured for directing the microwave energy into the heating chamber wherein the microwave energy couples with at least a portion of the microwave susceptor material.

10. The system of claim 8 wherein the fluid consists of a gas.

11. The system of claim 10 wherein the gas consists of an inert gas.

* * * * *